US005603463A

United States Patent [19]

Kumo et al.

[11] Patent Number: 5,603,463

[45] Date of Patent: Feb. 18, 1997

[54] BOBBIN HOLDER AND TAKE-UP DEVICE EQUIPPED WITH THE BOBBIN HOLDER

[75] Inventors: Ichiro Kumo, Shiga-ken; Kozo Okumura, Kyoto; Takao Sano; Tosihiro Hayasi, both of Shiga-ken, all of Japan

[73] Assignee: Toray Industries, Inc., Tokyo, Japan

[21] Appl. No.: 392,742

[22] PCT Filed: Jul. 14, 1994

[86] PCT No.: PCT/JP94/01154

§ 371 Date: Mar. 7, 1995

§ 102(e) Date: Mar. 7, 1995

[87] PCT Pub. No.: WO95/02551

PCT Pub. Date: Jan. 26, 1995

[30] Foreign Application Priority Data

Jul. 14, 1993 [JP] Japan ..... 5-174233

[51] Int. Cl.[6] ..... B65H 75/30; B65H 75/24

[52] U.S. Cl. ..... 242/46.4; 242/571.8; 242/576.1

[58] Field of Search ..... 242/571.8, 573.1, 242/576.1, 46.4, 46.6, 46.2, 130, 18 R

[56] References Cited

U.S. PATENT DOCUMENTS

| | | | |
|---|---|---|---|
| 2,365,980 | 12/1944 | Thomas | 242/46.2 X |
| 3,497,153 | 2/1970 | Young | 242/571.8 |
| 3,923,261 | 12/1975 | Isoard et al. | 242/571.8 X |
| 4,575,015 | 3/1986 | Sugioka et al. | 242/46.4 |
| 4,830,299 | 5/1989 | Mutter et al. | 242/46.4 |
| 4,852,819 | 8/1989 | Hasegawa et al. | 242/46.4 X |
| 4,993,651 | 2/1991 | Ohno et al. | 242/46.4 X |
| 5,217,175 | 6/1993 | Stitz et al. | 242/46.6 X |

FOREIGN PATENT DOCUMENTS

| | | | |
|---|---|---|---|
| 225534 | 1/1963 | Germany | 242/571.8 |
| 54-111579 | 8/1979 | Japan . | |
| 57-18362 | 4/1982 | Japan . | |
| 62-196268 | 8/1987 | Japan . | |
| 1-44533 | 12/1989 | Japan . | |
| 2-225268 | 9/1990 | Japan . | |
| 2-305767 | 12/1990 | Japan | 242/571.8 |
| 105403 | 9/1942 | Sweden | 242/571.8 |

*Primary Examiner*—Michael R. Mansen
*Attorney, Agent, or Firm*—Nikaido, Marmelstein, Murray & Oram LLP

[57] ABSTRACT

In a bobbin holder 1 according to the present invention, flexible rings 3*a* to 3*h* each comprising a ring-like spring member 30, a pair of solid rings 38 fixed to both side surfaces of the paring member 30, a pair of solid rings 38 fixed to both side surfaces of the spring member 30 and rubber members 39 disposed on the inner and outer peripheries of the spring member between the solid rings, are loosely fitted between a cylindrical bobbin 23 and a rotary cylinder 2 to which the bobbin is inserted. The solid rings 38 are pressed from both side surfaces of the flexible ring, respectively, and the ring-like spring member 30 undergoes deformation in the direction of an outer diameter so as to increase its diameter. As the rubber members 39 come into close contact with the inner peripheral surface of the bobbin 23, the bobbin can be gripped. In this case, in the bobbin holder described above, the difference δ between the outer diameter Ds of the rotary cylinder and the inner diameter Db of the bobbin is not greater than 10 mm and the thickness t at the end portion side of the rotary cylinder may be smaller than the thickness thereof at a portion near the engagement portion of the rotary cylinder with a driving shaft. When such a bobbin holder 1 is assembled into a take-up device for taking up a liner material such as a yarn and a steel wire or a synthetic resin film, a fiber sheet, paper etc, to the bobbin 23, high speed take-up while the bobbin is strongly gripped can be accomplished.

16 Claims, 9 Drawing Sheets

BOBBIN HOLDER AND TAKE-UP DEVICE EQUIPPED WITH THE BOBBIN HOLDER

TECHNICAL FIELD

This invention relates to improvements in a bobbin holder used for taking up a linear material such as a yarn or a steel wire, and a sheet-like material such as a synthetic resin film, a fabric and paper, and in a take-up device equipped with this bobbin holder. More particularly, the present invention relates to a bobbin holder which can accomplish high speed take-up while the bobbin is firmly gripped, without increasing the inner diameter of the bobbin, and to a take-up device equipped with this bobbin holder.

BACKGROUND ART

Recently, in a take-up device of a yarn used for a synthetic fiber production process, for example, higher performance has been sought so as to improve production efficiency, to reduce the cost of production and to improve and discriminate yarn quality. A take-up device equipped with a bobbin holder to which a bobbin having an entire length of greater than 1,000 mm is fitted and which can take up a yarn at a high speed of not lower than 6,000 m/min has been accomplished nowadays.

However, a further improvement in productivity and the reduction of the cost of production are extremely important factors for the synthetic fiber industry, and development of a bobbin holder of a so-called "small diameter elongated type", which can at a time grip a large number of small diameter bobbins capable of reducing the bobbin cost, and which can attain high speed take-up, and a take-up device using such a bobbin holder, has been desired.

The bobbin holders used for recent yarn take-up devices have been elongated in accordance with the requirement described above and have been used predominantly in the range of low number of revolutions which is lower than a high-order critical speed (hereinafter merely called the "critical speed (Nc)") which exceeds a low critical speed and which cannot be exceeded because vibration energy is excessively great.

An example of the conventional bobbin holders of such a type is described, for example, in Japanese Patent Laid-Open No. 225268/1990, and its general construction is shown in FIG. 11. Namely, the conventional bobbin holder 10 is fixed to the extreme left end portion of a bobbin holder shaft 14 directly coupled to a motor shaft 12 through a coupling 13, and comprises a rotary cylinder 15, a plurality of flexible rings 16*a* to 16*h* (eight rings are shown in the drawing) inserted to the outer periphery of the rotary cylinder, cylindrical spacers 17*a* to 17*g* for positioning the flexible rings, a front cover 17 for pushing the flexible rings 16*a* to 16*h* in the right-hand direction in the drawing and a push mechanism 20 comprising a coned disc spring 18 and a piston 19, for imparting the push force to the front cover in the right-hand direction in the drawing. Feed ports 12*a* and 14*a* for supplying compressed air are disposed in the motor shaft 12 and in the bobbin holder 14, respectively, and the flexible rings 16*a* to 16*h* are integrated by bonding a steel ring 22 to both side surfaces of a rubber ring 21 as shown in FIG. 12.

When bobbins 23 are gripped by the bobbin holder 10, the front cover 17 is moved to the right in the drawing by the push force of the coned disc spring (expanding force in the right-hand direction in the drawing) so as to compress each flexible ring 16*a*, 16*h* from the direction of both side surfaces. Since the volume of the rubber ring 21 hardly changes in this instance, the rubber ring increases its diameter and undergoes deformation by a volume corresponding to the change of compression from the direction of both side surfaces, and grips the bobbins 23. In other words, the greater the thickness of the rubber ring in the radial direction, the greater becomes the change of the volume with respect to an equal compressive change from the direction of the side surfaces, and deformation and the increase of the diameter corresponding to this change can be obtained to permit a strong grip on the bobbin. For this reason, the thickness of the flexible ring 16 according to the prior art becomes as great as 7 to 10 mm, and flexible rings having a smaller thickness cannot be used practically because deformation and the diameter increase becomes smaller and the bobbins cannot be firmly gripped.

On the other hand, when grip of the bobbin 23 is released, compressed air is supplied from a compressed air source, not shown, through the feed ports 12*a*, 14*a* so as to drive the piston 19 to the left in the drawing against the push force of the coned disc spring 18 and at the same time, the front cover 17 is moved to the left in the drawing to remove swelling of the rubber ring 21 due to deformation and the diameter increase and to release the bobbin 23.

According to the prior art described above, however, it is extremely difficult physically to provide a bobbin holder satisfying higher performance required in the future, that is, a bobbin holder capable of gripping a large number of bobbins having a small diameter and taking up a yarn at a high speed.

Next, the reason why the increased diameter of the bobbin holder 10 of the take-up device is essentially necessary to accomplish high speed take-up of the yarn in the prior art will be explained with a theoretical formula.

The constituent element that affects most greatly the determination of the specification of the bobbin holder 10 is the rotary cylinder 15 having the greatest length among the constituent elements, and its critical speed Nc, or in other words, its natural frequency, generally expressed by the following formula 1. The greater this value, the higher becomes the critical speed of the bobbin holder as a whole.

$$Nc \propto \frac{1}{L^2} \cdot \sqrt{\frac{I}{A}} \cdot \sqrt{\frac{E}{\rho}} \tag{1}$$

Here, the sectional area A and the second moment of area I of the rotary cylinder have the following relation with the outer diameter Ds and the inner diameter Di of the rotary cylinder, respectively:

$$A\alpha(Ds^2-Di^2),\ I\alpha(Ds^4-Di^4)$$

Accordingly, the formula 1 can be changed as follows:

$$Nc \propto \frac{\sqrt{Ds^2+Di^2}}{L^2} \cdot \sqrt{\frac{E}{\rho}} \tag{2}$$

Here, symbols E and ρ represent a Young's modulus and a specific gravity, respectively, and they are determined by the constituent material of the rotary cylinder 15. In the case of iron, they are generally 21,000 kg/mm$^2$ and 7.85, respectively, and it is not greatly expected at present that the critical speed Nc can be increased to a great value due to these values.

Accordingly, in order to improve the critical speed, the following means must be employed:

① to reduce the length L of the rotary cylinder;

② to increase the outer diameter Ds; or

③ to increase the value of the inner diameter Di as much as possible within the allowable range permitted by the strength of the high speed rotary body.

(1) As to the item ①, however, the length L is a value which is substantially determined by the full length of the bobbin 23 to be gripped, though it is designed to be as short as possible so as to improve the critical speed of the rotary cylinder 15. When eight bobbins each having a length L of 150 mm are gripped, for example, the length of the rotary cylinder 15 must essentially be a value approximate to the total length of the bobbins, i.e. 1,200 mm. Therefore, the length of from about 1,150 to about 1,200 is generally used, and this value cannot be reduced physically.

(2) As to the item ②, the diameters of the flexible rings 16*a* to 16*h* to be loosely fitted must he generally increased in order to increase the outer diameter Ds. This means essentially that the bobbins used must have a greater diameter, too. However, the increase in the diameter of the bobbins directly increases the cost of the bobbins, and the effects brought forth by the higher take-up speed and the improvement of productivity due to the increase of the critical speed (Nc) are offset by the increase of the bobbin cost.

Here, one effective means would be reducing as much as possible the thickness T of each flexible ring 16*a* to 16*h* in the radial direction and increases the outer diameter of the rotary cylinder 15. In other words, if the thickness of the flexible ring can be reduced without changing the inner diameter Db of the bobbins used, the outer diameter Ds of the rotary cylinder can be increased a corresponding amount, the critical speed of the bobbin holder can be increased and rotation at a higher speed becomes possible.

However, when the thickness T of each flexible ring 16*a* to 16*h* in the radial direction is merely reduced, the following problems occur. When eight bobbins 23 are held in the axial direction, for example, two flexible rings 16*a* to 16*h* are generally used for each bobbin and sixteen flexible rings, in total, are used. Each bobbin 23 is gripped by deformation of the flexible rings 16*a* to 16*h* in the direction of the outer diameter due to the push force from the front cover 17 as described above. When the thickness T is reduced on the basis of the concept described above, the total volume of the rubber ring 21 decreases and expansion in the direction of the outer diameter, capable of firmly gripping the bobbins 23 cannot be obtained even when the push force from the side surface direction acts. When the rubber ring 21 is merely elongated in the axial direction so as to compensate for the decrease of the volume resulting from the decrease of the thickness, the rubber ring 21 becomes a cylinder having a small thickness. Accordingly, it undergoes buckling when the push force acts on it and cannot expand in the direction of the outer diameter sufficiently for firmly gripping the bobbins 23.

On the other hand, the reduction of the thickness T of the flexible ring invites the problem in bobbin release. Even when the push force of the front cover 17 is released, the restoring force of the rubber ring 21 becomes small due to the reduction of the thickness of the flexible rings 16*a* to 16*h*. Though the rubber rings 21 of one or two flexible rings 16*a*, 16*b* near the front cover 17 return to their original shape, the diameter of the flexible rings 16*g*, 16*h*, etc, remote from the front cover 17 remains expanded because they cannot overcome the frictional force between the inner peripheral surface of the bobbins and the outer peripheral surface of the rotary cylinder 15, so that faulty bobbin removal occurs. As described above, the reduction of the thickness T of the flexible rings 16*a* to 16*h* in the radial direction so as to improve the critical speed of the rotary cylinder 15 to a high speed range cannot be accomplished as long as the prior art technology is employed.

Therefore, several prior art technologies are known as technologies which give specific design considerations to such a flexible ring. For example, U.S. Pat. No. 5,217,175 changes the sectional shape of the rubber ring that constitutes the flexible ring.

However, because the flexible ring relies only on the restoring force of the flexible material such as a rubber for the force of gripping the bobbin from the inner peripheral surface side, a sufficient gripping force cannot be obtained when the thickness is reduced. Further, the rubber ring in the means described above is shaped into the size of the outer diameter for gripping the bobbin under the state in which the stress from the direction of the side surface does not act, and when the bobbins are pulled out and removed, a tensile force is allowed to act on both side surface of the flexible ring so as to reduce the diameter and to cause deformation. In other words, since the bobbins are gripped under the state where any external force does not act, faulty bobbin gripping are likely to occur due to buckling of the rubber in the course of use for a long time and wear of its outer peripheral surface.

In the bobbin holder described in U.S. Pat. No. 3,923,261, the bobbin gripping portion is made only of a rubber material and applies the tensile force at the time of pull-out of the bobbins. Therefore, this Prior art involves the same problem as that of the flexible ring described above.

Accordingly, means for accomplishing the reduction of the thickness of the flexible ring, that is, means for increasing the outer diameter Ds of the rotary cylinder 15 without changing the inner diameter Db of the bobbins used, has not been accomplished at the present moment.

(3) Finally, in order to increase the inner diameter Di of the rotary cylinder 15 described in the item ③, the thickness t may be reduced, but when the thickness is excessively reduced, high-precision machining cannot be conducted and unbalance is likely to occur, so that excessive vibration is likely to occur at the time of high speed rotation. The decrease of the thickness t decreases the mechanical strength. Therefore, the flexible ring cannot withstand the centrifugal force at the high rotating speed, the possibility of mechanical damage exists, and destruction of the rotary cylinder might occur in the worst case.

In the case of a rotary cylinder having a full length of 1,150 mm, for gripping eight bobbins having an inner diameter of 94 mm, for example, the thickness of the rotary cylinder is set to about 4 to about 5 mm in order to insure precision of machining, at present. However, the reduction of the thickness to such a level cannot accomplish the improvement of the critical speed which can cope with the future need (refer to Japanese Patent Laid-Open No. 196268/1987, for example).

As described in the items (1) to (3), the prior art technologies have not been able to find any effective means for providing a bobbin holder for taking up the yarn at a high speed under the state where a large number of bobbins having a small diameter are held, by increasing the critical speed Nc of the rotary cylinder 15 to a high speed range without increasing the inner diameter of the bobbins.

DISCLOSURE OF THE INVENTION

The present invention has been completed in view of the background described above and is directed to provide an elongated bobbin holder capable of take-up at a high speed without increasing an inner diameter of bobbins, and a take-up device equipped with the bobbin holder.

In other words, the present invention has been completed so as to accomplish a technology capable of increasing the outer diameter of the rotary cylinder without increasing the inner diameter of the bobbins to be fitted to the bobbin holder. More concretely, the present invention aims at the provision of a bobbin holder capable of setting the difference T between the outer diameter Ds of the rotary cylinder and the inner diameter Db of the bobbin to not greater than about 10 mm, and a take-up device using the bobbin holder.

To accomplish the object described above, the invention relates to a bobbin holder including a driving shaft, a rotary cylinder which is rotated by the driving shaft and to the outer peripheral surface of which bobbins are fitted, flexible rings loosely fitted between the bobbins and the rotary cylinder, undergoing deformation by a compressive force from a side surface direction in such a manner as to increase the diameter thereof and gripping the bobbins from an inner peripheral surface side, and means for imparting a compressive force or a release force to the flexible rings from the side surface direction, wherein the flexible ring comprises:

(A) a spring member exhibiting substantially a ring-like shape and shaped in such a manner that the sectional shape thereof in the direction of the driving shaft is convexed in at least the direction of the outer diameter; and (B) rigid rings disposed on both side surfaces of the spring member.

Here, the term "spring member exhibiting substantially a ring-like shape" represents the means which undergoes deformation and the increase in diameter by the push force from the side surface direction and grips the bobbins from the side of the inner peripheral surface. In other words, the material of the spring member is not particularly limited so long as it has a property such that it can easily expand in the direction of the outer diameter and can undergo deformation and the increase of its diameter, has a restoring property in the direction of the inner diameter and has durability sufficient to withstand repeating loads of frequent compression and restoring. For example, the spring member is preferably a shaped spring consisting of a molded plate of a spring steel, a stainless steel, or hard plastics. A spring steel is preferable because elasticity is required. When the spring steel is used, its thickness is preferably from 0.01 to 0.5 mm and more preferably from 0.05 to 0.2 mm. The width in the direction of the driving shaft is not particularly limited, but the observation acquired by the inventors of the present invention reveals that the width is preferably from 1/10 to 1/5 times the outer diameter Ds of the rotary cylinder.

The sectional shape of the spring member may be convexed in at least the direction of the outer diameter so as to grip the bobbins. Besides the shape of the spring member 30 shown in FIG. 2, the shapes shown in FIGS. 5(A) and 5(B) may also be used. The height H of the convexity of the spring member 30 is preferably from 0.3 to 1.5 mm in view of machinability and ease of deformation and the diameter increase by the push force from the side surface direction. To generate expansion and the diameter increase, a notch portion to be expanded is preferably formed in the spring member, but the shape may be an elongated hole **30*b* shown in FIG. 3** or a mere slit. Such holes or slits may be disposed slantingly or non-uniformly. In other words, the arrangement and the shape are not particularly limited so long as the notches can expand when the spring member undergoes deformation and increases its diameter. The term "ring-like" means a "substantially ring-like" state as a whole. In other words, the spring member need not always form completely one continuous circular body but may be discontinuous and may form a "ring-like" shape as a whole. This also holds true of the rigid ring which will be described later.

To produce the thin spring member having such notches, a thin plate is first photoetched or punched and is then shaped into the ring form by electron beam welding. Further, the formation of the convex portion and correction of the degree of cylindricality are carried out by saddle machining. Punching may be used most preferably for machining the thin plate due to production costs.

The outer peripheral surface of the spring member which comes into contact with the inner peripheral surface of the bobbin when the spring member undergoes deformation and increases its diameter is preferably coated with a rubber material in order to more firmly grip the bobbins, and the material is preferably a synthetic resin such as a silicone rubber or urethane rubber and is more preferably a nitrile rubber having high chemical resistance and excellent aged deterioration.

The rigid rings disposed on both side ends of the spring member are means for fixing the spring member and loosely fitting it to the rotary cylinder. The material may be a metallic material such as an ordinary steel or aluminum, or hard plastics. General fixing means such as press-in, welding, etc, can be employed to fix the rigid rings to the spring member, but the combined use of press-in with fastening is most preferred because the production cost is relatively low and deformation does not occur after fixation.

The sectional shape of the rigid ring is most typically represented by L-shape indicated by reference numeral 38 in FIG. 2. Besides this L-shape, it may be a mere rectangular section or may be equipped with a slit formed on the rectangular section so as to receive the spring member. However, from the aspects of the production cost and ease of the fixing work, the L-shape described above is most preferred. If the width W of the rigid ring is too great, the production cost rises and a problem will occur when handling them, and if it is too small, on the contrary, the fitting and fixing property to the spring member drops. Accordingly, the width W is preferably from 1/2 to 1/10 times and more preferably from 1/2.5 to 1/5 times the width of the spring member.

The flexible ring used for the bobbin holder according to the present invention is equipped with the spring member and the rigid rings described above, and its outer diameter is smaller by about 0.5 to 1 mm than the inner diameter of the bobbin so that the bobbins can be easily removed. Its thickness in the radial direction is preferably as small as possible because the outer diameter of the rotary cylinder can be increased as much, but is preferably at least 1 mm and less than 5 mm and is more preferably from 2 to 4 mm in view of workability and the work efficiency.

The flexible ring explained above does not undergo buckling when it is pushed in the axial direction, though its thickness is reduced, but because the spring member undergoes deformation and increases its diameter in the direction of the outer diameter and comes into close contact with the inner peripheral surface of the bobbins with the strong force, the flexible ring can firmly grip the bobbins from the inner peripheral surface side, unlike the flexible ring according to the prior art wherein the material at the portion for gripping the bobbins from the inner peripheral surface side is made merely of a flexible material such as a rubber.

When the bobbins are released, too, the bobbins can be easily removed due to the diameter reduction function brought forth by the restoring force of the flexible ring. Furthermore, when the coarseness of the inner peripheral surface of the rigid ring is set to 0.2 to 100 S (surface coarseness JIS B0661-1970) and its surface hardness is set to Hv 200 to 900 (JIS B7725-1976), the frictional resistance between the rotary cylinder and the flexible ring can be remarkably reduced, so that the bobbins can be released more easily. According to the present invention, therefore, the thickness T of the flexible ring as the bobbin gripping means in the radial direction can be remarkably reduced to 1 to 5 mm in comparison with the conventional thickness of 7 mm, and the outer diameter Ds of the rotary cylinder can be increased as much. Incidentally, the outer diameter of the flexible ring is preferably set to about 60 to about 150 mm when a yarn take-up device having a take-up speed of at least 5,000 m/min and a bobbin holder length of 800 to 1,500 mm is constituted by using this flexible ring. Further, concavoconvexities on the contact surface between the cylindrical spacer and the flexible ring or the rubber-like coating needs be disposed on at least one of the side surfaces of these members. According to this arrangement, slip can he eliminated between the cylindrical spacer and the flexible ring and the torque or rotation or the braking torque can be reliably transmitted to the bobbins. The concavo-convexities on the contact surface have preferably the structure which does not generate slip, such as a tooth-shape, a wave shape, pins, and so forth. A material having a higher coefficient of friction than a metal, such as soft plastics, rubbers and viscous paints, is preferably used for the rubber-like coating.

Another embodiment relates to a bobbin holder comprising a driving shaft, a rotary cylinder which is rotated by the driving shaft and to the outer peripheral surface of which cylindrical bobbins are fitted and bobbin gripping means, wherein the difference between the outer diameter of the rotary cylinder and the inner diameter of the bobbin is not greater than 10 mm, and the thickness of the rotary cylinder at at least one of the end portions thereof is smaller than the thickness of the rotary cylinder near its engagement portion with the driving shaft.

Here, the term "driving shaft" represents a shaft body interposed as means for transmitting rotating motion to the rotary cylinder and includes the bobbin holder shaft 14 shown in FIG. 11, too, but it may be integrally constituted with the motor shaft 12 into one unit. Further, the term "engagement portion with the rotary cylinder" includes not only the case where the rotary cylinder and the driving shaft are constituted as mutually separate members as shown in FIG. 11 but also the case where both of them are integrally formed as shown in FIG. 13.

On the other hand, the rotary cylinder is the means, to the outer peripheral surface of which, the cylindrical bobbins are fitted, which determines the bobbin positions and fix them, and transmits the rotation from the driving shaft to the bobbins. The engagement portion may be disposed at any position inside the rotary cylinder. Generally, an engagement portion is disposed at a substantial center or at one of the end portions of the rotary cylinder, but a plurality of such engagement portions may be disposed, as well. However, one engagement portion is preferably disposed from the aspects of machinability and the machining cost, and most preferably, one engagement portion is disposed at a substantial center of the rotary cylinder.

The material of the rotary cylinder is not particularly limited so long as it can accomplish the object described above. It is possible to use, for example, steel materials such as chromimum-molybdenum steel, steels for mechanical structures, non-ferrous materials such as duralmin, titanium oxide, etc, and non-metallic materials such as carbon fiber reinforced resins, rigid plastics, and so forth. A plurality of these materials may be used in combination. Particularly preferred among them is the steel material from the aspect of machinability and the production cost, and most preferred is the chromium-molybdenum steel.

In order to accomplish the afore-mentioned object of the present invention, it is hereby important that the difference $\delta$ (Db–Ds) between the outer diameter Ds of the rotary cylinder and the inner diameter Db of the bobbin is not greater than 10 mm. More concretely, it is very important that the difference $\delta$ of the diameters is set to 1 to 10 mm and at the same time, and the inner diameter of the rotary cylinder is so set that the thickness at the end portion is smaller than the thickness in the vicinity of the boss portion.

The thickness t of the rotary cylinder preferably satisfies the relation $0<t<0.04$ Ds with the outer diameter Ds of the rotary cylinder at at least a part of the range where the distance from the end face is not greater than 70% of the distance from the end face to the end face which is most approximate to the engagement portion with the driving shaft. More preferably, the thickness t satisfies the relation $1.5\ \text{mm}<t<3$ mm with the range described above. However, the present invention does not contemplate a snap ring groove, an escape groove for a cutting tool, etc, from the aspect of machining.

The above will be explained in further detail with reference to FIG. 10.

In FIG. 10, the distance La represents the distance from the end face of the rotary cylinder to the nearest end face of the engagement portion on the front cover side of the rotary cylinder, and the thickness t of the rotary cylinder preferably falls within the range of $0<t<0.04$ Ds at at least a part of the range where the distance Lx is not greater than 70% of La. This also holds true of the distances Lb and Ly of the rotary cylinder on the motor side. Further, the length of the rotary cylinder in the axial direction is preferably from 800 to 1,500 mm in the same way as in the first embodiment.

When the difference $\delta$ between the bobbin inner diameter and the outer diameter of the rotary cylinder is reduced in this way, the following effects can be brought forth.

① The second moment of area I can be increased and deflection when a cutting tool is pushed at the time of machining of the rotary cylinder can be reduced. Accordingly, the thickness at the end portion can be further reduced.

② The inner diameter Di of the rotary cylinder can be increased by the extent corresponding to the increase of the outer shape, and insertion of the cutting tool when machining is conducted can be made easier. In other words, since high precision machining can be conducted, unbalance of the rotary body can be reduced.

Besides the bobbin gripping means shown in FIG. 1 using the flexible ring shown in FIGS. 2 and 5 as the bobbin gripping means of the invention capable of gripping the bobbins within a relatively small gap of the difference $\delta$ between the outer diameter Ds of the rotary cylinder and the inner diameter Db of the bobbin of not greater than 10 mm, U.S. Pat. No. 4,830,299, for example, discloses the construction wherein chuck pins comes out from, and into, a plurality of holes formed in the outer peripheral surface of the rotary cylinder and grip the inner peripheral surfaces of the bobbins. When the bobbin holder described in this U.S. Patent Specification is used, the difference between the outer diameter of the rotary cylinder and the inner diameters of the bobbins inserted into the bobbin holder can be set to an extremely small value of not greater than 1 mm, but in order to dispose the chuck pins, through-holes are necessary throughout the entire length and the entire periphery of the rotary cylinder, so that the strength drops and the possibility of stress concentration occurs. Moreover, the production cost becomes higher. Accordingly, the bobbin gripping means of FIG. 1 using the flexible ring shown in FIGS. 2 and 5 is preferred.

As explained above, the present invention can increase the diameter of the rotary cylinder without increasing the inner diameter of the bobbin and can therefore increase the sectional second moment of area. Accordingly, the present invention can elevate the critical speed of the rotary cylinder to the high speed range.

The take-up device equipped with the bobbin holder described above can accomplish high speed take-up, which has not been accomplished by the prior art technologies, and can expand the take-up range because of the effect of the increase of the critical speed of the bobbin holder.

A difference between the outer diameter of the rotary cylinder provided to the bobbin holder and the inner diameter of the bobbins to be fitted on the bobbin holder is kept below 10 mm, and the thickness of the rotary cylinder near the end portion is made smaller than its thickness near engagement portion between the rotary cylinder and the driving shaft. In this way, the present invention makes it possible to elevate the critical speed to the high speed range and to produce the bobbin holder with a higher level of precision.

Because the critical speed of the bobbin holder is elevated and because production accuracy becomes higher to eliminate unbalance and to reduce vibration of rotation, the take-up device equipped with the bobbin holder can accomplish high speed take-up which has not been accomplished by the prior art, and can expand the take-up range.

BEST MODE FOR CARRYING OUT THE INVENTION

Hereinafter, the best mode for carrying out the present invention will be explained with reference to the drawings.

Figure 1:
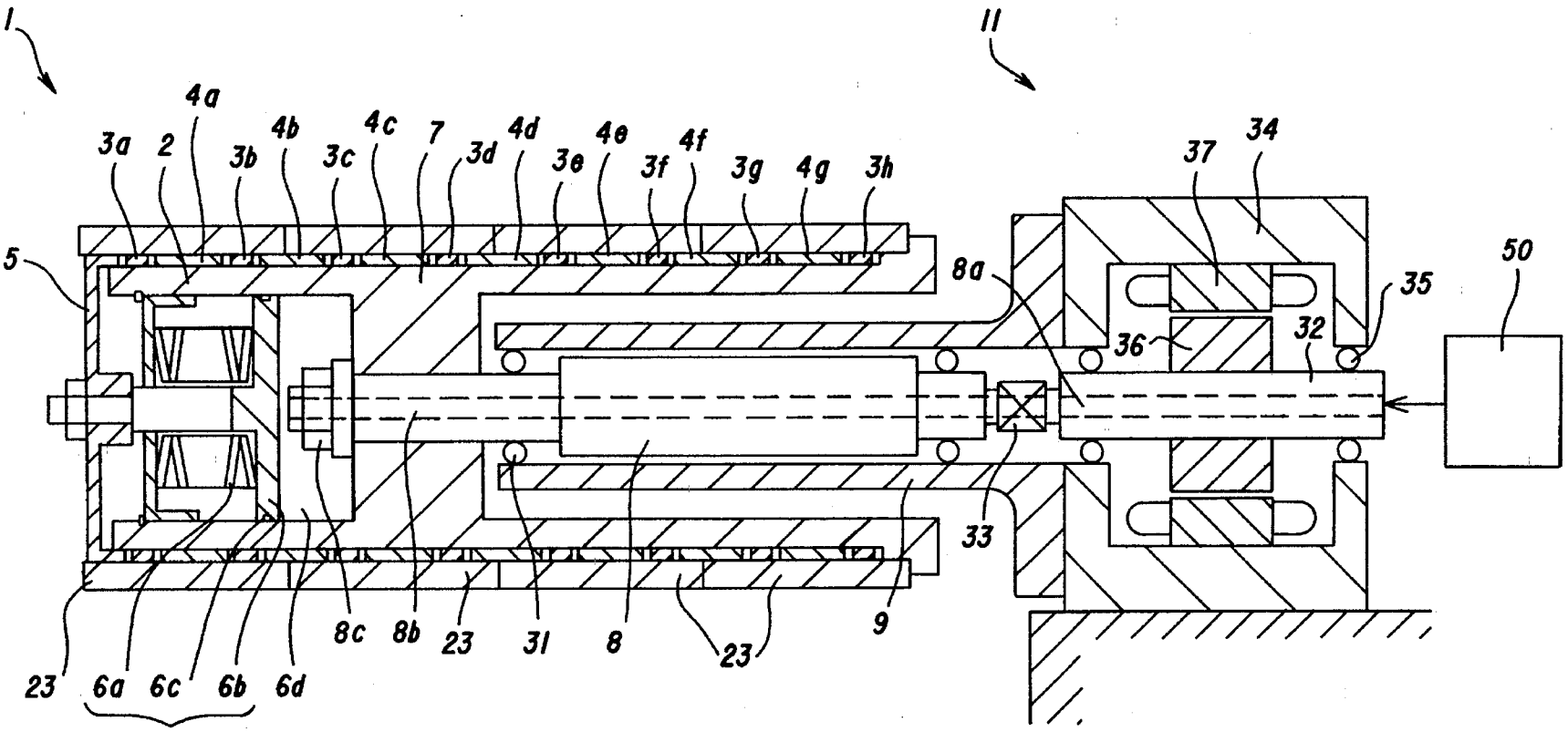
FIG. 1 is a longitudinal sectional view when a bobbin holder according to the first embodiment of the present invention is applied to a take-up device.

FIG. 1 is a longitudinal sectional view of the first embodiment wherein a bobbin holder according to claim 1 of the Scope of Claim for Patent is used for a yarn take-up device.

In FIG. 1, a bobbin holder 1 for gripping a 10 bobbin 23 comprises a rotary cylinder 2 having a boss portion 7 thereinside, a plurality of (eight, in the drawing) flexible rings 3*a* to 3*h* inserted into a longitudinal direction of the outer periphery of this rotary cylinder, cylindrical spacers 4*a* to 4*g* for positioning the flexible rings so that their fitting positions exist in the vicinity of both end portions of the bobbin 23, a front cover 5 for pushing the flexible ring 3*a* at the extreme left in the right-hand direction in the drawing, and a push mechanism 6 including a coned disc spring 6*a*, a piston 6*b* and an O-ring 6*c*.

Here, the rotary cylinder 2 is made of a chrominum-molybdenum steel which has widely been used generally as a structural member for high speed rotary bodies. As the boss portion 7 having an engagement portion of the rotary cylinder 2 is fastened to one of the ends of a bobbin holder shaft 8 by a nut 8*c* and the bobbin holder shaft 8 is supported by two bearings 31 fitted into a ring-like support 9, the rotary cylinder 2 is allowed to freely rotate. The other end of the bobbin holder 8 is directly coupled to a motor shaft 32 of a motor 11 by a coupling 33 and the motor shaft 32 is rotatably supported by two bearings 35 fitted to a motor housing 34. Further, an armature 36 is fixed to the motor shaft 32. A stator 37 is disposed in the motor housing 34 and transmits a driving force or a braking force to the bobbin holder 1 in cooperation with the armature 36. Reference numeral 8*a* denotes a compressed air feed port, and when compressed air is supplied to the motor shaft 32 from a compressed air feed source 50 such as a compressor or a blower, the piston 6*b* and the front cover 5 are moved to the left in the drawing, thereby releasing grip of the bobbin 23.

Figure 2:
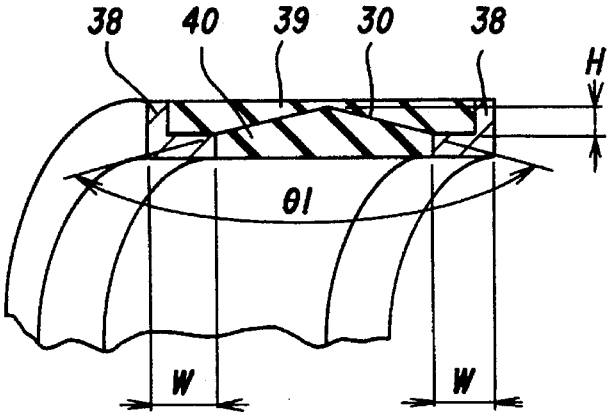
FIG. 2 is a sectional view of the principal portions of a flexible ring used in FIG. 1.
Figure 3:
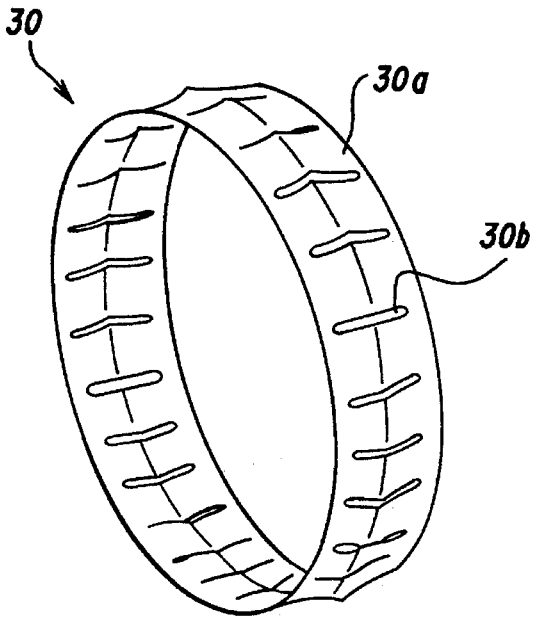
FIG. 3 is a perspective view of a spring member shown in FIG. 2.
Figure 4:
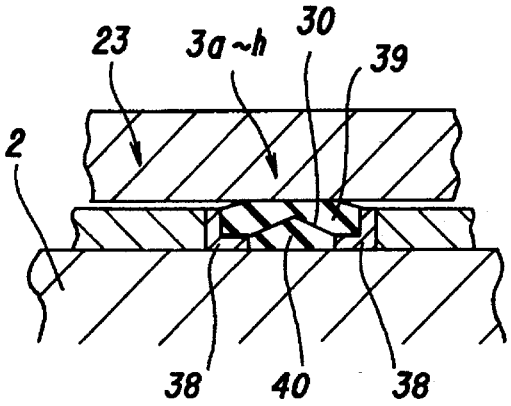
FIG. 4 is an enlarged sectional view of the vicinity of the flexible ring shown in FIG. 1.
Figure 5A:
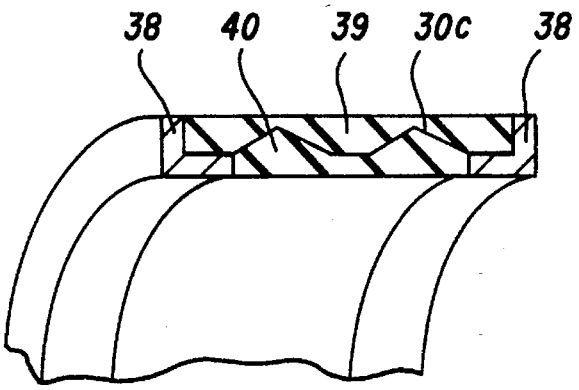
FIGS. 5(A) and 5(B) are sectional views of the principal portions of other examples of the spring members according to the present invention.
Figure 5B:
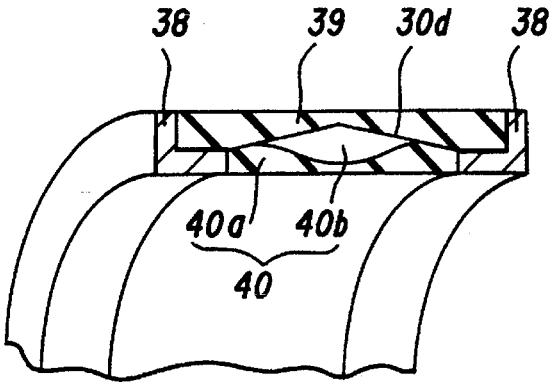

As shown in FIG. 2, each of the flexible rings 3*a* to 3*h* comprises a spring member 30, a pair of rigid rings 38 having an L-shaped sectional shape and rubber members 39, 40. Though the spring member 30 and the rigid ring 38 may be spaced apart from each other, they are preferably combined as shown in the drawing.

The spring member 30 is made of a material such as a spring steel, a stainless steel and rigid plastics, and has a thickness of 0.12 mm and a width of 20 mm. It includes an elongated hole 30*b* which is so expanded by a push force from the side surface direction as to increase its diameter and deform. The spring member 30 is bent into a convex shape having a crossing angle θ1 so that it is more likely to swell in the direction of the outer circumference and its height H in the radial direction is about 0.8 mm throughout the full periphery. Thirty-four elongated holes 30*b* are disposed uniformly throughout the entire periphery having a major diameter of 14 mm and a minor diameter of 2 mm. The crossing angle θ1 is preferably from 90° to 180° so as to reduce the stroke by the push mechanism 6 and is more preferably set to 140° to 175° at which a so-called toggle mechanism can be utilized, in consideration of the bobbin gripping force.

A production method of the spring member 30 comprises shaping the outer shape into a flat sheet shape by photo-etching, forming the ring form by electron beam welding, and correcting the cylindricality and at the same time, forming the convexity by effecting saddle machining. The solid ring 38 is made of the stainless steel. After the stainless steel is shaped into the L shape by cutting, the spring member 30 described above is pushed into it. When a large number of solid rings 38 are produced the rigid rings 38 are produced more preferably by die-casting an aluminum material.

The rubber members 39, 40 are means for firmly gripping the bobbin 23 on its inner peripheral surface when the spring member 30 expands in the direction of the outer diameter. They are so disposed as to encompass the spring member 30. Though its material is not limited in particular, a nitrile rubber having a rubber hardness of 20 to 60 degrees is preferred. After the spring member 30 is pushed into the rigid ring 38, the rubber members 39, 40 are simultaneously vulcanized and shaped.

Each of the flexible rings 3*a* to 3*h* produced in the way described above has an outer diameter of 60 to 150 mm and a thickness of at least 1 but less than about 5 mm in the radial direction. The outer diameter of the flexible rings 3*a* to 3*h* is smaller by about 0.5 to about 1 mm than the inner diameter of the bobbin 23 so as to facilitate bobbin release.

The cylindrical spacers 4*a* to 4*g* are made of aluminum, and the outer diameter is by about 0.5 to about 1 mm smaller than the inner diameter of the bobbin 23 to be gripped, in the same way as the flexible rings 3*a* to 3*h* in consideration of tightening of winding. Incidentally, the material of the cylindrical spacers may be an ordinary iron steel or a light-weight material such as plastics or carbon fiber reinforced resins.

Next, the gripping method of the bobbin 23 will be explained with reference to FIGS. 1 through 4.

First, when compressed air charged into the cylinder 6*d* is exhausted outside the system from the compressed air feed port 8*a* by opening a compressed air exhaust valve, not shown, the piston 6*b* is moved by the push force of the coned disc spring 6*a* to the right in the drawings, and at the same time, the front cover 5 pushes the flexible ring 3*a* at the extreme left to the right in the drawings. Then, both side surface of each flexible ring 3*a* to 3*h* is pushed by the cylindrical spacers 4*a* to 4*g* and the gap between the rigid rings 38 and 38 becomes small, so that the spring member 30 is caused to swell in the direction of the outer circumference throughout the entire periphery in such a manner as to increase the diameter and the rubber member 39 is pushed out towards the bobbin 23. As the outer peripheral surface of the rubber member 39 comes into close contact with the inner peripheral surface of the bobbin 23, the bobbin 23 is gripped concentrically and tightly by the rotary cylinder 2. When the bobbin holder shaft 8 is rotated by the motor 11, the rotary cylinder 2 rotates while gripping the bobbin 23.

When compressed air is supplied into the cylinder 6*d* from the compressed air feed source 50 through the compressed air feed ports 8*a*, 8*b* by opening the compressed air feed valve, not shown, the piston 6*b* moves to the left in the drawings against the push force of the coned disc spring 6*a*, the shapes of the rubber members 39, 40 and the spring member 30 restore to their original shapes and their outer diameters decreases to release grip of the bobbin 23.

Figure 11:
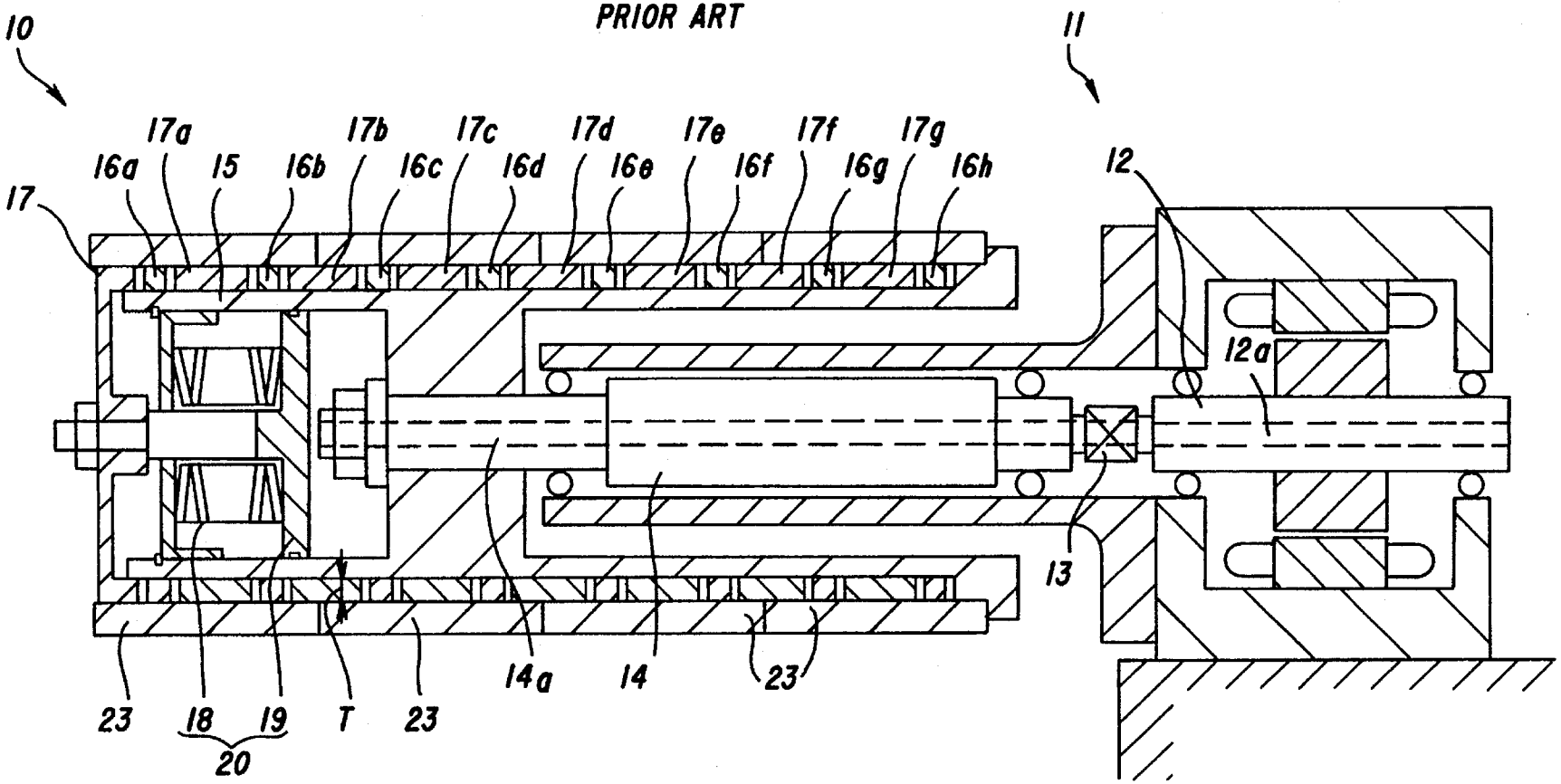
FIG. 11 PRIOR ART
FIG. 11 is a longitudinal sectional view showing a bobbin holder according to the prior art.

The bobbin holder 1 shown in FIGS. 1 to 4 is constituted by the rotary cylinder 2 having a length of 1150 mm by setting the outer diameter of the flexible ring 3 to 93.2 mm and its width to 25 mm so that eight bobbins 23 having an inner diameter of 94 mm and a length of 150 mm can be inserted. The thickness T of the flexible ring according to the prior art shown in FIGS. 11 and 12 cannot be reduced below about 7 mm and for this reason, the outer diameter of the rotary cylinder 2 is 80 mm. In contrast, the diameter can be increased to 87 mm in this embodiment because the thickness of the flexible ring 3 in the radial direction can be reduced.

Next, the improvement in the critical speed of the bobbin holder 1 brought forth by the use of the flexible ring of the present invention over the prior art technologies will be explained with reference to FIG. 6.

Figure 6:
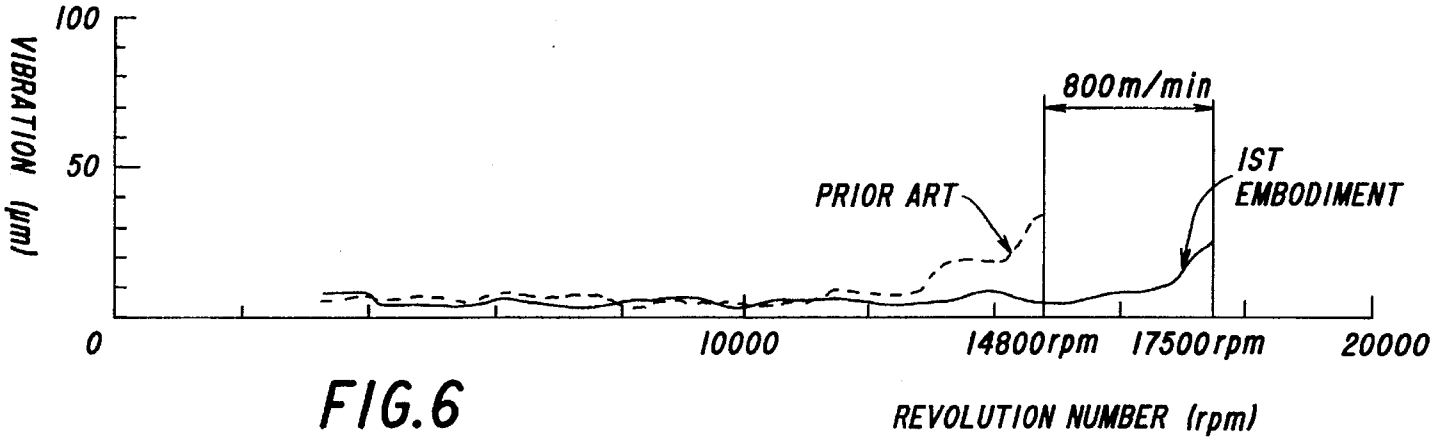
FIG. 6 is a diagram showing the result of a rotation test of the first embodiment shown in FIG. 1.

First, when eight bobbins 23 were inserted into the take-up device shown in FIG. 1 and were rotated by the motor 11, the bobbin holder can be rotated at 17,500 rpm as represented in FIG. 6. On the other hand, the bobbin holder according to the prior art which had an outer diameter of 80 mm can be rotated at only up to 14,800 rpm. In other words, in the actual yarn take-up operation, whereas the prior art technology can take up only at up to 4,700 m/min in terms of the bobbin peripheral speed, the present invention can make high speed take-up of 5,500 m/min corresponding to the improvement of 800 m/min brought forth due to the improvement in the critical speed.

This means that in the bobbin holder 10 according to the prior art, the outer diameters of the rotary cylinder 15 and the bobbin 23 were increased so as to take up the yarn at the speed of 5,500 m/min, but the present invention does not involve such a requirement.

Next, in order to examine the bobbin gripping force of the bobbin holder 1 according to the present invention, the bobbin gripping force was measured under the stationary state of the bobbin holder.

Figure 12A:
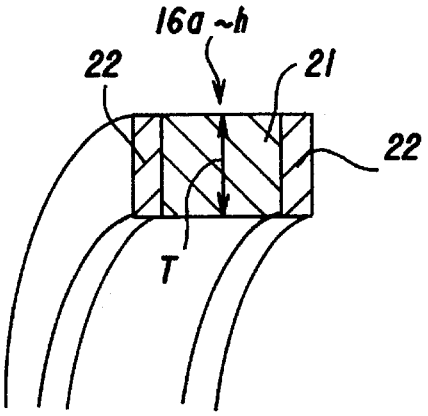
FIG.12(A) PRIOR ART
FIG. 12 is a sectional view showing the principal portions of a flexible ring shown in FIG. 11.

Three kinds of flexible rings, that is, ① the flexible ring of the present invention shown in FIG. 2, ② the flexible ring according to the prior art shown in FIG. 12(A) and ③ a flexible ring having the same outer diameter as that of the flexible ring of the present invention and having the same structure as that of the flexible ring according to the prior art, were used for the measurement.

The measurement method was as follows. A rotary cylinder to which eight bobbins 23 having an inner diameter of 94 mm and a length of 150 mm was assembled in the same way as the bobbin holder used for the rotation test shown in FIG. 6. After eight bobbins were inserted, a rotating torque was applied to each of the bobbins while a mechanical brake was applied to the motor shaft 32 shown in FIG. 1. The rotating torque at the time when slip started occurring in the bobbin in the rotating direction was measured, and this value was used as the gripping strength of each flexible ring.

The result is tabulated in Table 1. Incidentally, the bobbins 23 in Table 1 correspond sequentially to bobbin numbers I, II, III, . . . , VIII from the side of the front cover 5 to the side of the motor 11.

TABLE 1

Measurement Result of Bobbin Gripping Force

| Bobbin No. | Bobbin gripping force (kg · m) ① Example | ② Comp. Example 1 | ③ Comp. Example 2 |
|---|---|---|---|
| I | 2.4 | 2.5 | 1.4 |
| II | 2.3 | 2.4 | 1.3 |
| III | 2.2 | 2.4 | 1.1 |
| IV | 2.4 | 2.1 | 0.9 |
| V | 2.3 | 2.2 | 0.8 |
| VI | 2.2 | 2.1 | 0.7 |
| VII | 2.3 | 2.0 | 0.7 |
| VIII | 2.2 | 1.9 | 0.5 |

Condition of Flexible Rings:
① Example: outer diameter 93.2, inner diameter 87, width 25 (mm), material: nitrile rubber, hardness 40 degrees, with spring member
② Comparative Example: outer diameter 93.2, inner diameter 80, width 13 (mm), material: nitrile rubber, hardness 40 degrees, without spring member
③ Comparative Example: outer diameter 93.2, inner diameter 87, width 13 (mm), material: nitrile rubber, hardness 40 degrees, without spring member It can be understood from Table 1 that although the thickness T becomes smaller, the flexible ring 3 according to the present invention has a bobbin gripping force equivalent to that of the flexible ring 16 according to the prior art. Further, whereas the drop of the bobbin gripping force was observed on the motor side as in the flexible rings having the bobbin numbers VII and VIII according to the prior art, the flexible rings according to the present invention could obtain a substantially uniform gripping force.

Figure 12B:
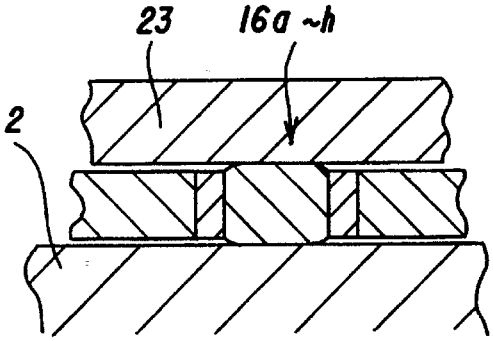
FIG.12(B) PRIOR ART
Figure 13:
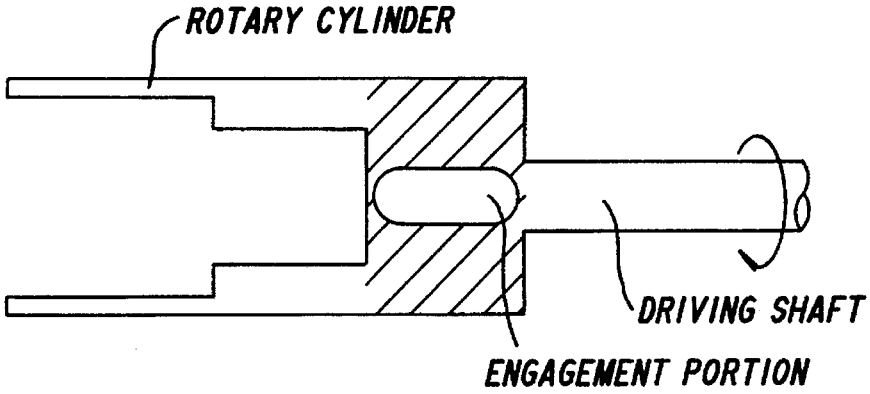
FIG.13 PRIOR ART
FIG. 13 is a view showing an engagement portion between the rotary cylinder of the bobbin holder and a cylinder body according to the prior art.

The reason is as follows. In the flexible ring 3 according to the present invention, the spring member is so shaped as to protrude in the direction of the outer shape. Therefore, its diameter increases only in the direction of the outer shape when the spring member receives the push force from the side surface. In contrast, the flexible ring according to the prior art has the structure shown in FIG. 12(A). Therefore, when the push force acts from the direction of the side surface, deformation occurs in the direction of the inner peripheral surface, too, as shown in FIG. 12(B). Under such a state, the frictional force occurring between the flexible ring 16 on the front cover 5 side such as those of the bobbin number I to III and the rotary cylinder 15 to which the flexible ring is loosely fitted gradually drops, and the deformation quantity of the flexible ring in the direction of the outer periphery decreases gradually toward the motor 11.

To further reduce the frictional resistance between the inner peripheral surface of the flexible ring and the outer peripheral surface of the rotary cylinder, it is preferred to set the coarseness of the inner peripheral surface of the rigid ring 38 to 0.2 to 100 S (surface coarseness JIS B0661-1970) and the surface hardness HV to 200 to 900 (JIS B7725-1976). When these values are satisfied, the frictional resistance between the rotary cylinder and the flexible ring becomes small and the drop of the push force by the push mechanism 6 becomes more difficult to occur. Accordingly, grip of the bobbin and its release become more reliable.

In the flexible ring of ③, the deformation quantity in the outer peripheral direction sufficient to grip the bobbin could not be obtained, and in the cases of the bobbin numbers IV to VIII, the value was below 1.0 kg m as a scale of the gripping force and was out of the range of practical application.

Further, in the flexible rings 16 according to the prior art, permanent deformation of about 1 mm occurred in the direction of the outer diameter in the coarse of use for about 5 months, and catch occurred when the bobbins were inserted. However, the flexible ring 3 according to the present invention kept the dimension and the gripping force which hardly changed even after the passage of about one year from the time of fitting due to the effect of the spring member 30, and could continue take-up.

Figure 7:
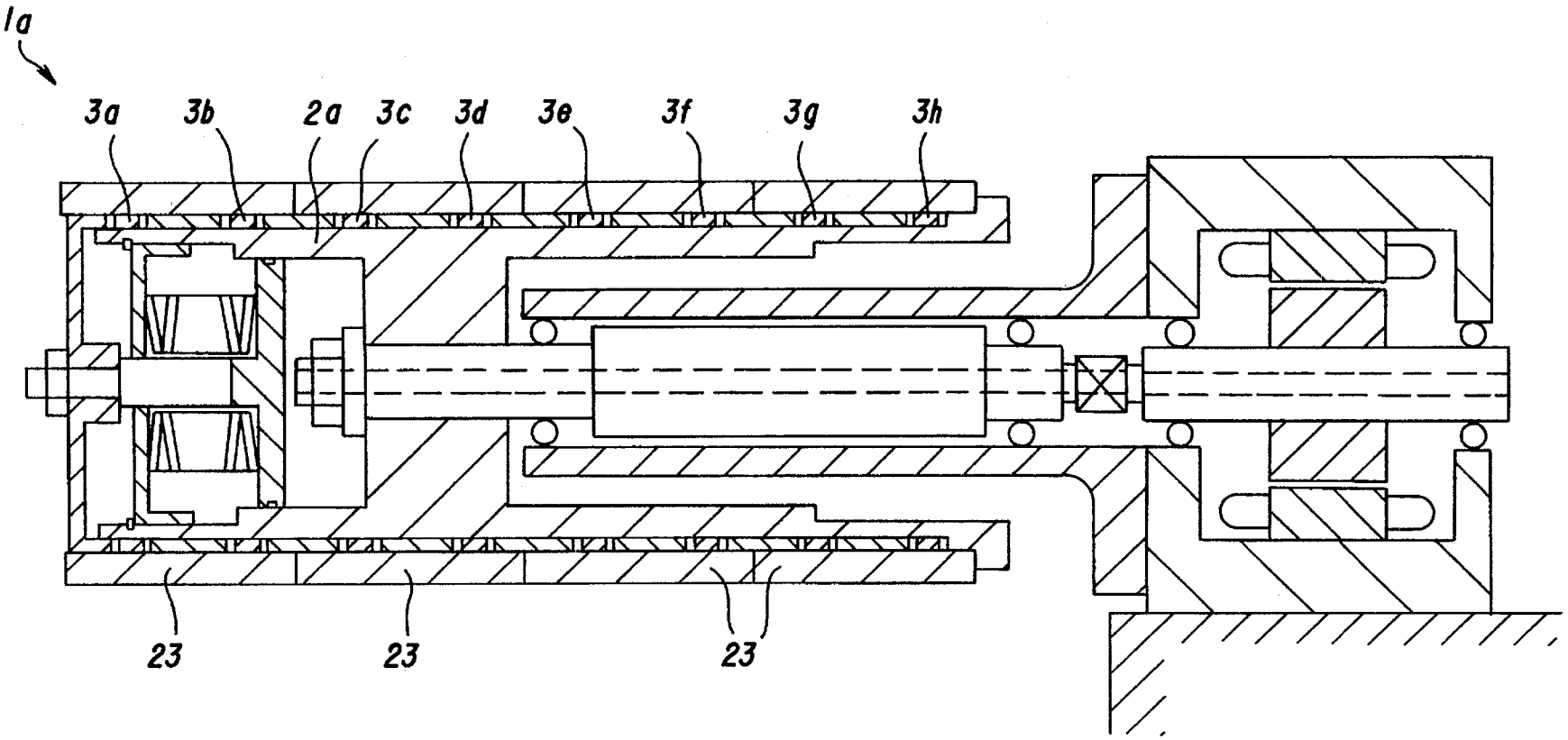
FIG. 7 is a longitudinal sectional view when a bobbin holder according to the second embodiment of the present invention is applied to a take-up device.

FIG. 7 is a longitudinal sectional view of the bobbin holder 1*a* according to another embodiment. The bobbin holder relates to the second embodiment of the present invention and employs the same structure as that of the first embodiment with the exception of the structure of the rotary cylinder 2*a*.

In other words, to grip eight bobbins 23 having an inner diameter of 94 mm (only four bobbins are shown in the drawing for convenience's sake) in the same way as in the first embodiment, the experiment was carried out by using a rotary cylinder 2*a* having an outer diameter of 87 mm (the difference δ between the inner diameter of the bobbin and the outer diameter of the rotary cylinder=7 mm). Incidentally, the upper limit value of the outer diameter of the rotary cylinder was less than 94 mm which was the inner diameter of the bobbin. The flexible ring 3 having the spring member 30 was fitted between both members.

Figure 8:
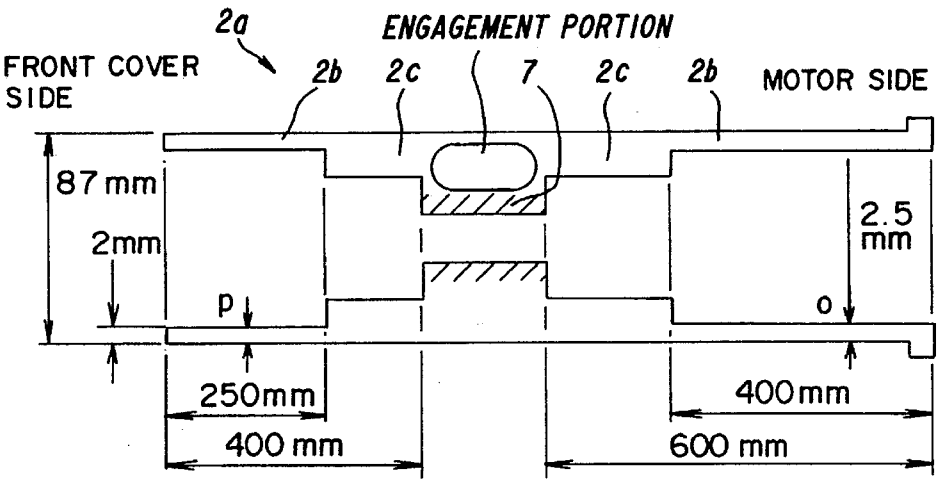
FIG. 8 is a longitudinal sectional view showing the principal dimension of a rotary cylinder of the take-up device shown in FIG. 7.

FIG. 8 is a view showing the sectional shape and the principal dimension of the rotary cylinder 2*a* as a characterizing feature of the present invention.

The rotary cylinder 2*a* has a full length of 1,150 mm, is made of a chromium-bolybdenum steel and is equipped at the substantial center with the boss 10 portion 7 as the engagement portion with the bobbin holder shaft 8 not shown in the drawing, in the same way as in the first embodiment. Further, the thickness t of both end portions 2*b* of the rotary cylinder is smaller than the thickness of the portion 2*c* near the engagement portion, and the thickness is 2 mm from the distal end to a distance of 250 mm on the side of the front cover 5, and is 2.5 mm from the distal end to a distance of 400 mm on the motor side.

Here, the portion of the rotary cylinder at which the thickness t is reduced may be at least one of its end portions. However, it is of course better to reduce the thickness at both end portions. The berm "thickness of the portion 2*c* near the engagement portion" means the thickness of the cylinder 2*c* in the proximity of the boss portion 7. In the rotary cylinder 15 according to the prior art having the outer diameter Ds of 80 mm, the limit thickness is about 3.5 mm which is the limit of the second moment of area, but because the outer diameter is increased in the rotary cylinder 2*a* according to the present invention, the thickness can be reduced to 2.5 mm and at the same time, both outer and inner diameters can be increased as can be clearly seen from the afore-mentioned formula 2, so that a bobbin holder having a higher critical speed, that is, a bobbin holder capable of coping with a higher speed, can be obtained.

Figure 9:
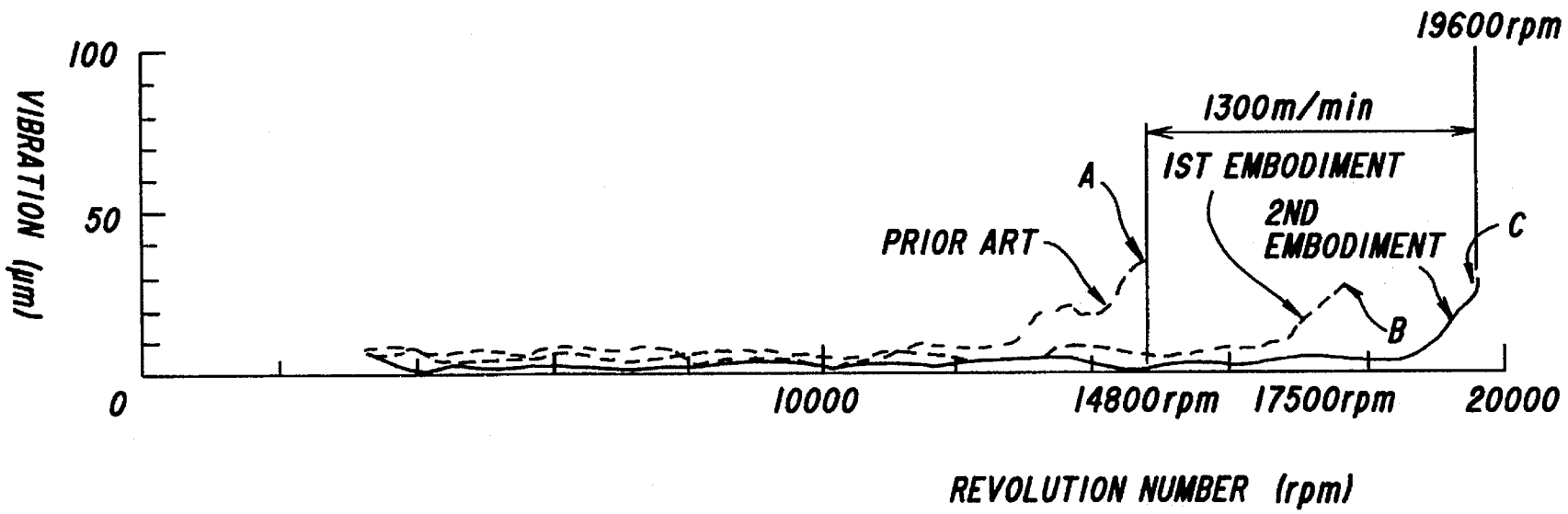
FIG. 9 is a diagram showing the result of a rotation test of the second embodiment.
Figure 10:
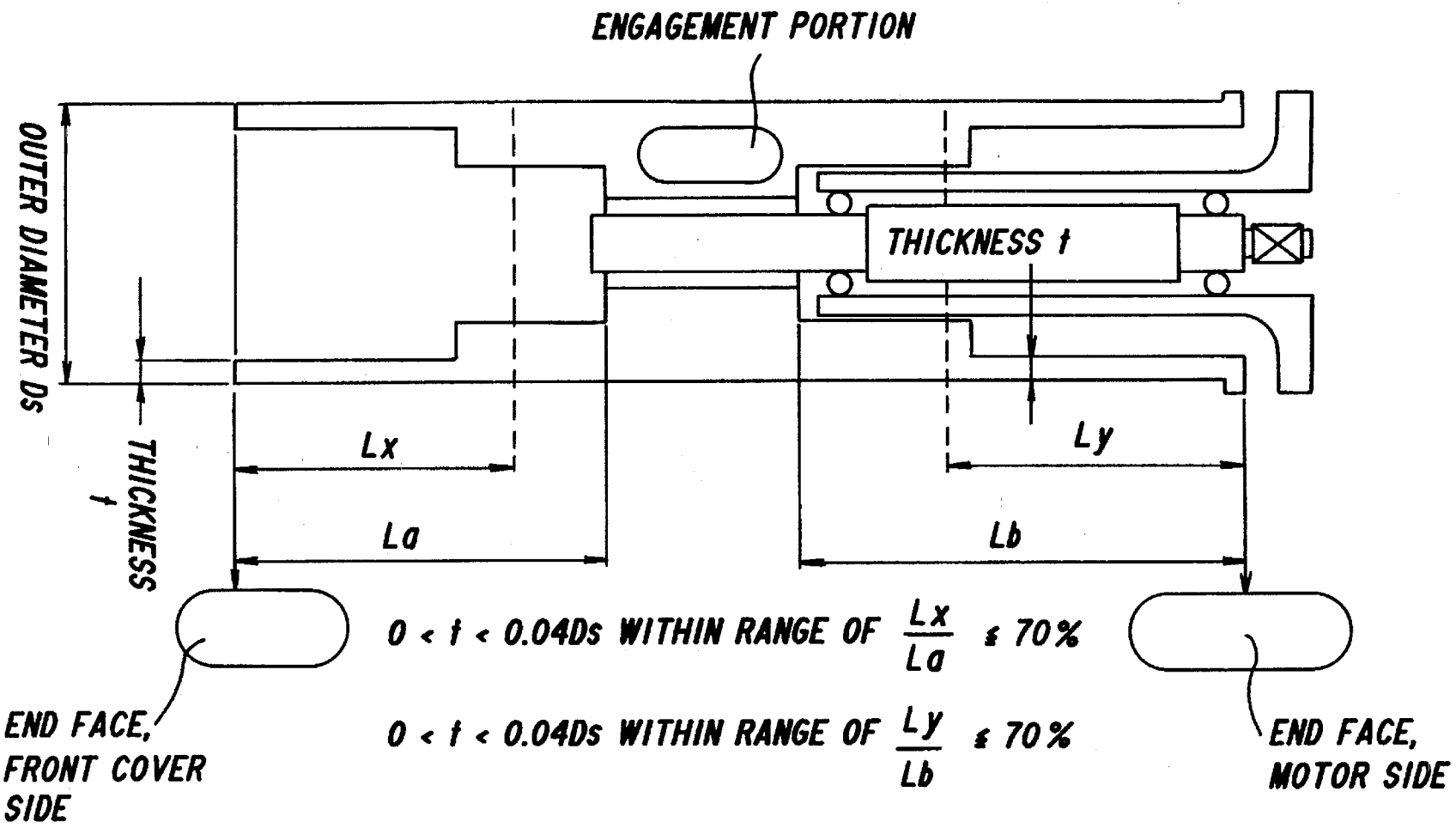
FIG. 10 is a model view showing the shape of the rotary cylinder according to the present invention.

Eight bobbins 23 were inserted into the bobbin holder 1*a* having the rotary cylinder 2*a* described above and were rotated. FIG. 9 shows the result. As can be seen from the diagram, the critical speed of the bobbin holder can be further improved from the first embodiment and can rotate in a high speed range of 19,600 rpm, and high speed take-up at 6,000 m/min can be accomplished in taking up the yarn. In comparison with the conventional bobbin holder described in the first embodiment, the improvement of 4,800 rpm in terms of the number of revolutions and 1,300 m/min in terms of the take-up speed of the yarn can be accomplished.

Symbols A to C in the diagram represent the rotation test results by the prior art, the first embodiment and the second embodiment of the present invention, respectively.

Furthermore, the winding test of the yarn was carried out in the following way. First, two types of rotary cylinders, that is, a type having the end face shape according to the prior art and another in which the thickness at the end portions was smaller than the thickness near the engagement portion, were produced for each of the rotary cylinders having outer diameters Ds of 83 mm, 84 mm, 85 mm and 86 mm, respectively. Each of these rotary cylinders was assembled into a bobbin having an inner diameter of 94 mm and a full length of 1,200 mm by the flexible ring 3 having the same structure as that of FIG. 2.

The test results are tabulated in Table 2.

TABLE 2

Results of Take-up Test

| Test No. | Condition: bobbin inner diameter Db mm | Condition: outer diameter of rotary cylinder Ds mm | Condition: diameter difference δ mm | Condition: end shape of rotary cylinder | Effect Take-up speed m/min: 5000 | Effect Take-up speed m/min: 5500 |
|---|---|---|---|---|---|---|
| ① | 94 | 83 | 11 | prior art | x | x |
| ② | 94 | 83 | 11 | thin thickness | Δ | x |
| ③ | 94 | 84 | 10 | prior art | ○ | Δ |
| ④ | 94 | 84 | 10 | thin thickness | ⊙ | ○ |
| ⑤ | 94 | 85 | 9 | prior art | ⊙ | Δ |
| ⑥ | 94 | 85 | 9 | thin thickness | ⊙ | ⊙ |
| ⑦ | 94 | 86 | 8 | prior art | ⊙ | ○ |
| ⑧ | 94 | 86 | 8 | thin thickness | ⊙ | ⊙ |

Explanation of Symbols:
⊙: take-up was satisfactory, vibration was less than 5 μm.
○: take-up could be made, vibration was within an allowable range of 5 to 10 μm.
Δ: Though rotation could be made, take-up could not be made because the vibration level was too high. vibration was at least 30 μm.
x: Rotation could not be made.

It could be understood from the test results tabulated in Table 2 that high speed take-up of the yarn at 5,500 m/min as the target of the present invention could be made by using the bobbin holders in which the difference δ between the outer diameter Ds of the rotary cylinder and the inner diameter Db of the bobbin was not greater than 10 mm and the thickness at the end portions of the rotary cylinder was smaller than the thickness of the engagement portion.

Since the bobbin holder and the take-up device according to the present invention use the flexible ring 3 of the first embodiment, they do not at all involve the problems of the bobbin gripping force and the restoring force at the time of release and have excellent performance in long term durability. Accordingly, continuous take-up of the yarn without inviting the stop of the apparatus for frequent change of the flexible ring can be accomplished.

Industrial Applicability

The bobbin holder and the take-up device using the bobbin holder according to the present invention can be naturally used for winding linear materials such as a yarn and a steel wire to the bobbin, and can be suitably applied also to sheet-like materials such as a synthetic resin film, woven and knitted fabrics, non-woven fabrics and paper.

The bobbin holder and the take-up device equipped with the bobbin holder described in claims 1 and 10 of the present invention can provide the following excellent functions and effects.

① Unlike the prior art technology which relies on the rubber member to obtain the bobbin gripping force of the flexible ring and the restoring force at the time of release, the present invention uses the ring-like spring member. Accordingly, the thickness of the rotary cylinder in the radial direction can be sufficiently reduced and the bobbin can be reliably gripped by a strong strength. Therefore, the diameter of the rotary cylinder can be increased while the inner diameter of the bobbins to be inserted is kept unchanged as in the prior art, and the critical speed of the bobbin holder can be elevated to the high speed range. In consequence, high speed take-up can be accomplished.

② Because the flexible ring is provided with the spring member, permanent deformation of the rubber member, which has occurred in the conventional flexible rings, does not occur, and the replacement cycle of the flexible ring can be extended. For this reason, frequent stop of the device is not required, and the working factor of the take-up device can be improved.

③ The moving distance of the flexible ring in the axial direction can be reduced by the distance corresponding to the decrease of the stroke of the push mechanism, the rubber member of the flexible ring does not swell towards the rotary cylinder, and the inner surface of the solid ring is so machined as to possess a predetermined coarseness and a predetermined hardness. These factors together reduce the contact frictional resistance between the rotary cylinder and the flexible ring, and the push force from the front cover in the axial direction is not reduced midway but is sufficiently transmitted to the rear portion. Accordingly, bobbin grip becomes more reliable and the stop of the operation of the device due to breakage of the yarn resulting from the bobbin slip during winding can be remarkably reduced.

④ Complicated machining and specific production technique are unnecessary to produce the constituent members other than the flexible ring. Accordingly, the high operation speed of the take-up device can be accomplished extremely economically. Because existing take-up device, too, can cope with high speed take-up by merely changing the rotary cylinder and the flexible ring, innovation of the setup can be accomplished at a reduced modification cost.

⑤ Since the inner diameter of the bobbin is not increased, modification of conveyor equipment on the downstream side of the take-up device is not necessary, and the cost of the bobbins becomes lower in comparison with the case where the take-up speed is increased by increasing the inner diameter of the bobbin.

We claim:

1. A bobbin holder comprising a driving shaft, a rotary cylinder which is rotated by said driving shaft and over an outer peripheral surface of which a plurality of bobbins are fitted, flexible rings loosely fitted between said bobbins and said rotary cylinder, means for imparting a compressive force to said flexible rings from a side surface direction and means for imparting a release force to said flexible rings against said compressive force, said flexible ring comprising:

(A) a spring member exhibiting substantially a ring-like shape, a cross section shape thereof in the direction of said driving shaft being convex in a radial direction toward an outer diameter of said spring member;

(B) rigid rings encompass said spring member, wherein said flexible ring is capable of being deformed by said compressive force to increase a diameter thereof and grip said bobbin from an inner peripheral surface side.

2. A bobbin holder according to claim 1, wherein the material of said spring member comprises at least of a spring steel, a stainless steel or hard plastics.

3. A bobbin holder according to claim 2 wherein a crossing angle θ1 of said cross section shape of said spring member is from 90° to 180°.

4. A bobbin holder according to claim 1 or 2, wherein rubber members, for encompassing said spring member, are interposed between said rigid rings.

5. A bobbin holder according to claim 1, wherein the thickness of said flexible ring in the radial direction is at least 1 mm and less than 5 mm.

6. A bobbin holder according to claim 1, wherein a plurality of said flexible rings are disposed in the axial direction of said driving shaft with predetermined gaps defined between them.

7. A bobbin holder according to claim 1, wherein coarseness of the inner peripheral surface of said rigid ring is from 0.2 to 100 S and its surface hardness is Hv 200 to 900.

8. A bobbin holder according to claim 1, wherein said compressive force or said release force is imparted from a direction of the side surface of said flexible ring through a flexible ring press member, and a rubber-like material is applied to at least one of the side surfaces of said flexible ring or on at least one of the side surfaces of said flexible ring press member.

9. A bobbin holder according to claim 1 wherein a crossing angle θ1 of said cross section shape of said spring member is from 90° to 180°.

10. A bobbin holder according to claim 1, wherein said means for imparting a compressive force to said flexible rings from the side surface direction comprises at least one compression spring and a front cover provided at one end of said rotary cylinder and said means for imparting a release force to said flexible rings against said compressive force comprises said front cover and a pressurized fluid injection means.

11. A bobbin holder comprising a driving shaft, a rotary cylinder which is rotated by said driving shaft and over an outer peripheral surface of which a plurality of bobbins are fitted and bobbin gripping means, wherein a difference δ between an outer diameter (Ds) of said rotary cylinder and an inner diameter (Db) of a bobbin is not greater than 10 mm, and a thickness (t) at an end portion of said rotary cylinder satisfies a relation of $0<t<0.04$ Ds wherein said outer diameter (Ds) is in at least a part of a range not greater than 70% of a distance from an end face of said rotary cylinder to an end face of an engagement portion with said driving shaft.

12. A bobbin holder according to claim 11, wherein said bobbin gripping means is a flexible ring comprising:

a spring member exhibiting substantially a ring-like shape and shaped in such a manner that the sectional shape thereof in the direction of said driving shaft is convexed in at least the direction of an outer diameter thereof, and rigid rings disposed on both side ends of said spring member.

13. A bobbin holder according to claim 12, wherein the thickness (T) of said flexible ring in the radial direction is at least 1 mm and less than 5 mm.

14. A bobbin holder according to claim 13, wherein the length of said rotary cylinder in the axial direction is from 800 to 1,500 mm.

15. A bobbin holder according to claims 1 or 11, wherein said rotary cylinder comprises a cylinder and a boss portion disposed at a substantial center of the inside of said cylinder, and said driving shaft is engaged at said boss portion.

16. A take-up device comprising:

(A) said bobbin holder according to any of claims 1 or 11;

(B) bearing means for rotatably supporting said driving shaft of said bobbin holder; and (C) driving means of said bobbin holder, coupled to said driving shaft of said bobbin holder.

* * * * *